US005765417A

United States Patent [19]

Bolton

[11] Patent Number: 5,765,417

[45] Date of Patent: Jun. 16, 1998

[54] FREE WHEEL LOCK CYLINDER

[75] Inventor: Brian Lewis Bolton, Kirksville, Mo.

[73] Assignee: U-Shin Ltd., Tokyo, Japan

[21] Appl. No.: 626,988

[22] Filed: Apr. 3, 1996

[51] Int. Cl.[6] ..... E05B 29/10

[52] U.S. Cl. ..... 70/495; 70/379 R; 70/422

[58] Field of Search ..... 70/188, 189, 422, 70/492, 495, 496, 379 R, 379 A, 380, 375

[56] References Cited

U.S. PATENT DOCUMENTS

| | | | |
|---|---|---|---|
| 1,644,092 | 10/1927 | Shinn | 70/492 |
| 3,410,123 | 11/1968 | Jacobi | 70/422 |
| 5,577,409 | 11/1996 | Oyabu et al. | 70/422 X |

FOREIGN PATENT DOCUMENTS

| | | | |
|---|---|---|---|
| 0770941 | 9/1934 | France | 70/492 |
| 1159307 | 12/1963 | Germany | 70/492 |
| 1-299968 | 12/1989 | Japan . | |
| 4-182582 | 6/1992 | Japan . | |
| 4-198569 | 7/1992 | Japan . | |
| 4-198570 | 7/1992 | Japan . | |
| 4-198571 | 7/1992 | Japan . | |
| 4-198572 | 7/1992 | Japan . | |

*Primary Examiner*—Lloyd A. Gall
*Attorney, Agent, or Firm*—Wenderoth, Lind & Ponack

[57] ABSTRACT

A free wheel lock cylinder includes a main rotor having a plurality of slits communicating with a key hole and a recessed portion communicating with both the slits and the key hole. Tumblers, having positioning notched portions formed on upper edge portions thereof, are slidably received in the slits of the main rotor. An engagement bar, having an underside engageable with the positioning notched portions of the tumblers, is received in the recessed portion of the main rotor and is biased toward the tumblers. A rear rotor is engageable with the main rotor through an interlocking device that is movable in response to operation of the engagement bar. When a proper key is inserted in the key hole of the main rotor, the engagement bar engages aligned positioning notched portions of the tumblers. The main rotor engages the rear rotor through the interlocking device moving in response to the operation of the engagement bar so that the rear rotor turns in response to rotation of the main rotor.

28 Claims, 7 Drawing Sheets

FREE WHEEL LOCK CYLINDER

BACKGROUND OF THE INVENTION

1. Field of the Invention

The present invention relates to a lock cylinder for use in automotive and household door locking devices.

2. Description of the Prior Art

Generally, lock cylinders are used in automotive and household door locking devices. The lock cylinder comprises a cylinder and a rotor provided in the cylinder. The rotor is rendered rotatable within the cylinder by inserting a proper key (matching key) into the rotor. Unless the key is inserted into the rotor, or with an improper key (non-matching key), a tool or the like as inserted in the rotor, tumblers projecting from the rotor engage engagement recesses formed on the inner periphery of the cylinder so that the rotor is blocked from rotating. A key lever is connected to a rear end portion of the rotor, and to this key lever is connected a rod through which the door locking device is driven.

However, such a lock cylinder of the prior art involves a problem that if a non-matching key or tool or the like is inserted in the rotor to apply a large load to the tumblers, the tumblers may be broken to allow the rotor to turn, so that the door lock is disengaged. As a result, theft is possible.

A known lock cylinder is described in Japanese Patent Application Laid-Open No. 1-299968. In such lock cylinder, when a key is not inserted in the rotor, the tumblers and the side bar projecting from the rotor come into engagement with engagement grooves in a casing, which prevents the rotor from turning. When a proper key is inserted in a key groove of the rotor, the tumblers are drawn into slots formed in the rotor so that the side bar engages abutment portions of the respective tumblers aligned in a row. As a result, the side bar shifts inwardly of the outer periphery of the cylinder. Therefore, when the key is turned, the rotor is allowed to rotate.

However, in such lock cylinder of the above described construction, as the side bar is biased by two side springs held directly against opposite edge portions of the side bar, it is necessary that the side bar and the springs be accommodated within the same space. This involves the provision of a space large enough to accommodate the side bar and springs. In practice, however, it is not easy to accommodate the side bar and springs within a lock cylinder of limited capacity. Moreover, a separate support member is required for supporting the side bar, and this results in an increased number of parts and an increased number of assembly operations.

In the lock cylinder of the above described arrangement, the distance of travel of the side bar is very small, i.e. no more than the depthwise dimension of abutment portions provided in the tumblers. This makes it difficult to achieve accurate engagement/disengagement operations and therefore can lead to malfunction.

Further, the above described lock cylinder has a limitation in that the spring force of the tumbler spring cannot be designed to be very strong from the standpoint of operability, to which is added the fact that the side bar is biased by side springs toward the tumbler. Therefore, if an improper key having a similar outer configuration is inserted in the tumblers, and if the side bar happens to even slightly engage abutment portions of the tumblers which may have been moved as a consequence of insertion of the improper key, it is not possible to positively force out the side bar by the spring force of the tumbler spring from the abutment portions of the tumblers. This results in a reduced amount of side bar engagement relative to the casing, and in some cases the tumblers may possibly slide under a component of force of the side spring until the side bar goes into complete engagement with abutment portions of the tumblers. Therefore, the problem is that if the lock cylinder is forcibly turned, under these circumstances, a malfunction may occur.

Known free wheel type lock cylinders have limitations including many small component parts, intricate and complex assembly, overall large size, excessive weight, excessive cost and unusual operation.

SUMMARY OF THE INVENTION

The present invention substantially eliminates the above-described disadvantages.

It is an object of the present invention to provide a lock cylinder which can prevent the occurrence of theft by high load disruption.

It is another object of the invention to provide a lock cylinder which is smaller in size and which requires a smaller number of parts and a smaller number of assembly operations than known free wheel lock cylinders.

It is another object of the invention to provide a lock cylinder which is capable of accurate engagement and disengagement and which is free of any possibility of malfunction.

It is another object of the invention to provide a lock cylinder which is free of any possibility of malfunction even if an improper key having a similar outer configuration is inserted and which is capable of theft prevention.

According to one aspect of the present invention, there is provided a lock cylinder comprising:

a main rotor having a plurality of slits extending laterally thereof and communicating with a key hole extending in the axial direction of the main rotor, the main rotor further having a recessed portion communicating with both the slits and the key hole;

tumblers each having a positioning notched portion formed on an upper edge portion thereof, the tumblers being adapted to be slidably received in the slits of the main rotor;

an engagement bar having an underside engageable with the positioning notched portions of the tumblers, the engagement bar being received in the recessed portion of the main rotor and being biased toward the tumblers; and a rear rotor engageable with the main rotor through interlocking means movable in response to the operation of the engagement bar;

wherein when a proper key is not inserted in the key hole of the main rotor, the rear rotor does not turn if the main rotor is rotated; and wherein when the proper key is inserted in the key hole of the main rotor, the engagement bar engages aligned positioning notched portions of the tumblers, and the main rotor engages the rear rotor through the interlocking means moving in response to the operation of the engagement bar so that the rear rotor turns in response to the rotation of the main rotor.

In this arrangement, even if an improper key or the like is inserted to forcibly turn the main rotor, the rear rotor will not rotate and the main rotor will turn idly alone.

More specifically, in the lock cylinder of the present invention, when an improper key or the like is inserted into the key hole of the main rotor, tumblers do not slide to the predetermined position and therefore the engagement bar cannot fit in the positioning notched portions of the tumblers. As such, the interlocking means cannot allow the main rotor to be engaged by the rear rotor. As a result, even if the improper key, inserted into the main rotor, is forcibly manipulated for rotation, only the main rotor is allowed to turn idly and the rear rotor will not rotate. Thus, any such act of unlocking through destruction, as has been experienced with conventional lock cylinders is rendered impossible. In this way, the lock cylinder of the invention is effective for theft prevention.

According to another aspect of the invention, there is provided a lock cylinder comprising:

a main rotor having a plurality of slits extending laterally thereof and communicating with a key hole extending in the axial direction of the main rotor, the main rotor further having a recessed portion communicating with both the slits and the key hole;

tumblers each having a positioning notched portion formed on an upper edge portion thereof, the tumblers being adapted to be slidably received in the slits of the main rotor;

an engagement bar having an underside engageable with the positioning notched portions of the tumblers, the engagement bar being received in the recessed portion of the main rotor and being biased toward the tumblers;

a lever having a tongue abuttable against an upper surface of the engagement bar, the lever being pivotally mounted to the main rotor;

a spring supported by the lever for biasing the engagement bar through the tongue toward the tumblers; and a rear rotor engageable with the main rotor through a locking pawl of the lever movable in response to the operation of the engagement bar;

wherein when a proper key is not inserted in the key hole of the main rotor, the rear rotor does not turn if the main rotor is rotated; and wherein when the proper key is inserted in the key hole of the main rotor, the engagement bar engages aligned positioning notched portions of the tumblers, and a locking pawl of the lever movable in response to the operation of the engagement bar moves into engagement with the rear rotor so that the rear rotor turns in response to the rotation of the main rotor.

In this arrangement, under the spring force of the spring supported by the lever, the tongue of the lever biases the engagement bar toward the tumblers, and the locking pawl of the lever moves into locking engagement with the rear rotor.

Therefore, the lock cylinder of the invention is characteristically different from conventional lock cylinders in that the biasing force of the spring is applied to the engagement bar through the lever. For this reason, both the engagement bar and the spring need not be accommodated within the same space.

Further, since the spring is supported by the lever, it is not necessary to separately provide a support member, and this results in a reduced number of parts and a reduced number of assembly operations required. In particular, the decrease in the number of parts results in reduction of assembly errors and improvement in operating characteristics.

According to one preferred embodiment of the invention, the distance between the pivot center of the lever and the working point of the locking pawl locked to the rear rotor is longer than the distance between the pivot center of the lever and the working point of the tongue biasing the engagement bar.

This embodiment provides an advantage that since the amount of travel of the engagement bar within the main rotor is increased through the lever, the amount of travel by the locking pawl of the lever relative to the height of the projection of the rear rotor can be increased. This insures accurate engagement and disengagement, and thus any possibility of malfunction can be prevented effectively.

According to another preferred embodiment of the invention, on at least one of opposite surfaces of the key is formed a key groove extending in the longitudinal direction of the key, and on an inner peripheral edge portion of each of the tumblers is formed a positioning projection engageable with the key groove.

Alternatively, on at least one of opposite surfaces of the key is formed a positioning ridge extending in the longitudinal direction of the key, and on an inner peripheral edge portion of each of the tumblers is formed a positioning recess engageable with the positioning ridge.

In these embodiments, upon insertion of the key into the tumblers, a tapered face of the key urges the inner peripheral edge portions of the tumblers to cause the tumblers to slide. This provides a larger amount of tumbler shift for key disengagement, thus ensuring accurate disengagement. Thus, malfunction and theft difficulties can be prevented effectively.

After the inner peripheral edge portions of the tumblers are first biased by the tapered face of the key to cause the tumbler to slide, the key groove or the positioning ridge of the key is engaged by the positioning projections or the positioning recesses of the tumblers. Accordingly, the load upon the positioning projections or recesses of the tumblers is reduced, so that the positioning projections or recesses are unlikely to become damaged, with the result of improved service life.

According to another preferred embodiment of the invention, the forward end portion of the key defines a tapered face to provide a sharp pointed end, whereby when the key is inserted into the tumblers, the tapered face of the key urges the inner peripheral edge portions of the tumblers to cause the tumblers to slide, thereby to guide the positioning projections or recesses of the tumblers to the key groove or ridge of the key.

In this embodiment, upon insertion of an improper key having a similar outer configuration or the like, the key groove of such key engages the positioning projections formed in the inner peripheral edge portions of the tumblers to forcibly cause the tumblers to slide. As a result, the engagement bar is accurately forced out from the positioning notched portions of the tumblers. Thereby, it thus is possible to prevent any malfunction due to the use of an improper key and also to prevent any possibility of theft.

It is only required that one key groove be provided on at least one of the opposite surfaces of the key. Unlike conventional keys, therefore, the key of the invention has a uniform sectional area and is less liable to become damaged.

BRIEF DESCRIPTION OF THE DRAWINGS

Further objects and advantages of the present invention will become clear from the following description taken in conjunction with preferred embodiments thereof with reference to the accompanying drawings, in which.

DETAILED DESCRIPTION OF THE PREFERRED EMBODIMENTS

Figure 1:
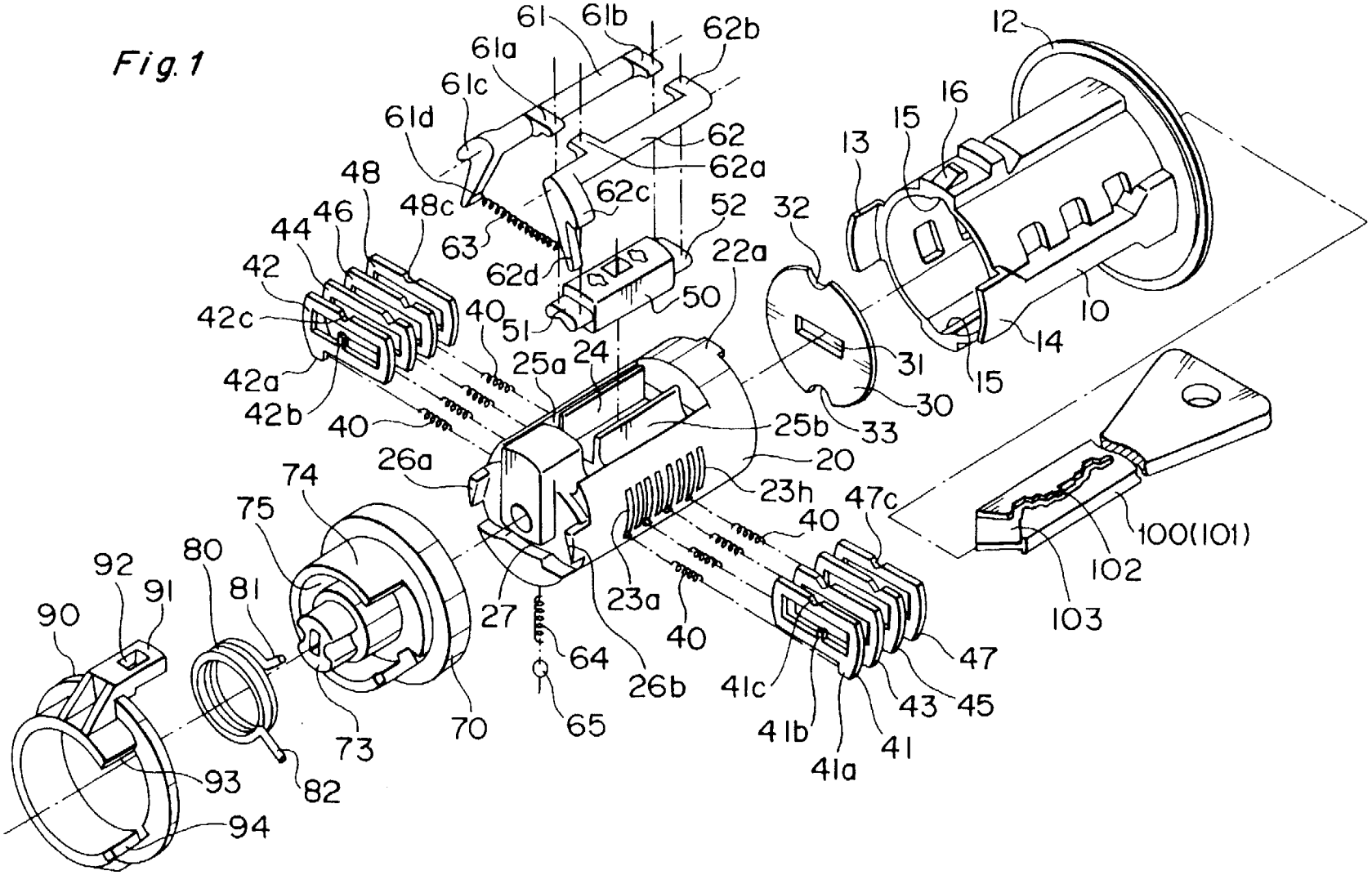
FIG. 1 is an exploded perspective showing one embodiment of a lock cylinder according to the present invention.

One embodiment of the present invention will now be described with reference to FIGS. 1 through 4.

The lock cylinder according to the invention comprises a cylindrical holder 10, a main rotor 20 rotatably housed in the cylindrical holder 10, a rear rotor 70 disposed for engagement with a rear end portion of the main rotor 20, a cap 90 holding the rear rotor 70 from slipping out of the holder 10 and a torsion spring 80 biasing the rear rotor 70 to a rotationally neutral position.

The holder 10 has a cylindrical configuration such that the main rotor 20 to be described hereinafter can be accommodated in the holder 10. The holder 10 includes a collar portion 12 having a key insertion hole 11 which is formed in a front open portion, and a pair of positioning arms 13, 14 extending from opposite side edges of a rear open portion along the axis of the holder 10. Further, the holder 10 has a pair of click grooves 15 formed on vertically opposed upper and lower surfaces of its inner periphery. Shown at 16 is a locking pawl.

The main rotor 20 has a generally cylindrical outer configuration. The main rotor 20 includes a key hole 21, capable of receiving a key 100 (to be described hereinafter), which extends from the front end of the main rotor 20 along the axis thereof. The main rotor further includes locking projections 22*a*, 22*b* formed at vertically opposed edge portions of the front end for engagement with a rotor cover 30 to be described hereinafter. The main rotor 20 has slit openings 23*a*–23*h* formed side by side at a predetermined pitch. The slit openings 23*a*–23*h* extend laterally through opposite sides of the main rotor 20 and communicate with the key hole 21. The main rotor 20 has a recess 24 formed centrally in its upper surface. The recess 24 communicates with the key hole 21 and slit openings 23*a*–23*h* and can receive an engagement bar 50 to be described hereinafter. At opposite sides of recess 24 are formed elongated grooves 25*a*, 25*b* for pivotally receiving left and right levers 61, 62 which are to be described hereinafter. The main rotor 20 has a pair of locking projections 26*a*, 26*b* formed at opposite side edges of the rear end thereof and also has a notched groove 27 formed at a location beneath the projections. The main rotor 20 is formed at the underside thereof with a receiving hole 28 (FIG. 2) which receives a ball 65 and a spring 64.

The rotor cover 30 has at a central location therein a center hole 31 through which the key 100 can pass and, at upper and lower edges thereof, has notched portions 32, 33 adapted to be engaged by locking projections 22*a*, 22*b* of the main rotor 20. In the main rotor 20, there is provided a shutter, not shown, which is biased to closing the center hole 31 of the rotor cover 30, so that the interior of the main rotor 20 is shielded from rain, water, and dust.

The slit openings 23*a*–23*h* of the main rotor 20 receive tumblers 41–48 having a generally square configuration in front elevation. The tumblers 41–48 have respective projections 41*a*–48*a* (only outermost ones shown) formed at outer peripheral lower edges thereof, respective positioning projections 41*b*–48*b* (only outermost ones shown) formed at inner peripheral edges thereof, and respective positioning notched portions 41*c*–48*c* formed at their upper edges thereof. Further, opposite side edges of the tumblers 41–48 have a curvature identical with that of the outer periphery of the main rotor 20. The positioning notched portions 41*c*–48*c* of the tumblers 41–48 are so formed as to be in an operable alignment when the positioning projections 41*b*–48*b* engage a groove of predetermined configuration in the key 100.

Figure 3:
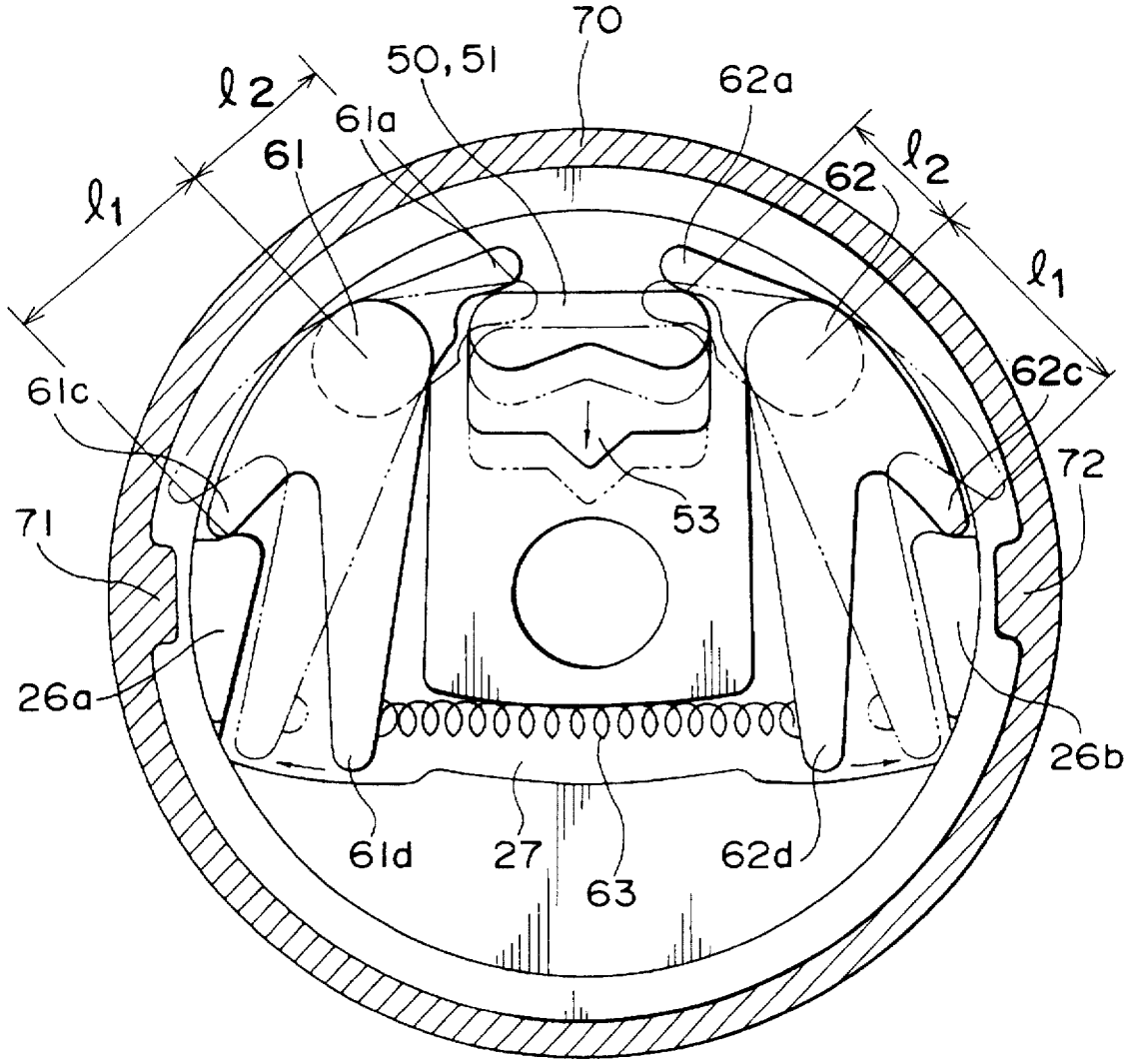
FIG. 3 is a transverse sectional view showing an essential part thereof.

The engagement bar 50 has a planar configuration adapted for engagement with the recess 24. The engagement bar 50 includes abutment projections 51, 52 extending from its front and rear ends in opposite directions, and a ridge-like raised portion 53 of a triangular shape in section which extends downward from the underside of the engagement bar 50 (FIG. 3).

The left and right levers 61, 62 respectively comprise pairs of inwardly extending tongues 61*a*, 61*b* and 62*a*, 62*b*. From rear ends of the levers 61, 62 extend locking pawls 61*c* and 62*c* and extensions 61*d* and 62*d* for holding a lever spring 63 therebetween. The distance $l_1$ between respective pivot centers of the left and right levers 61, 62 and respective working points of the locking pawls 61*c* and 62*c* for locking engagement with the rear rotor 70 which will be described hereinafter is longer than the distance $l_2$ between respective pivot centers of the left and right levers 61, 62 and respective working points of the pairs of tongues 61*a*, 61*b* and 62*a*, 62*b* biasing the engagement bar 50.

The rear rotor 70 has a configuration adapted for engagement with the rear end of the main rotor 20. The rear rotor 70 includes a pair of locking projections 71, 72 formed on the inner periphery thereof at opposed front locations as shown in FIG. 3. The rear rotor 70 also includes a connecting shaft 73 extending from a center portion of its rear end, and an annular projection 74 encompassing the outer periphery of the connecting shaft 73 to define an annular groove 75 for receiving a coil spring 80.

A method of assembling a complete unit of the present embodiment from the above described components now will be explained.

Tumblers 41–48 are slidably inserted into slit openings 23*a*–23*h* of main rotor 20, against the force of respective springs 40, from opposite sides in alternate sequence.

Then, engagement bar 50 is fitted in the recess 24 of main rotor 20, and left and right levers 61, 62 are rotatably received respectively in elongated grooves 25*a*, 25*b*, with spring 63 being placed in notched groove 27 of main rotor 20 to stretch extensions 61*d* and 62*d* outwardly. Thus, the force of spring 63 causes pairs of tongues 61*a*, 61*b* and 62*a*, 62*b* apply pressure from above to abutment projections 51, 52 of engagement bar 50, thereby to bias the engagement bar 50 downwardly.

Click ball 65 is mounted in receiving hole 28 of main rotor 20 via spring 64. Notched portions 32, 33 of rotor cover 30 are brought into engagement with locking projections 22*a*, 22*b* of main rotor 20 to cover the front opening of the key hole 21. Thereafter, main rotor 20 is accommodated within the holder 10. As a result, outer ends of tumblers 41–48, slidably received in slit openings 23*a*–23*h* and outwardly biased by the spring force of springs 40, abut against the inner periphery of the holder 10.

Coil spring 80 is mounted in annular groove 75 of rear rotor 70, after the annular cap 90 has been fitted in position.

The rear rotor 70 is thus brought into engagement with the rear end of the main rotor 20 housed in the holder 10, and engagement hole 92 of a slip-off preventive portion 91 extending from the annular cap 90 is caused to be engaged by locking pawl 16 of the holder 10 in order to prevent any possibility of slip-off of cap 90. The assembly process thus is completed.

With the assembly completed as above described, opposite ends of the coil spring 80 engage notched edge portions 93, 94 of the annular cap 90 to bias the rear rotor 70 to a rotationally neutral position.

Figure 4:
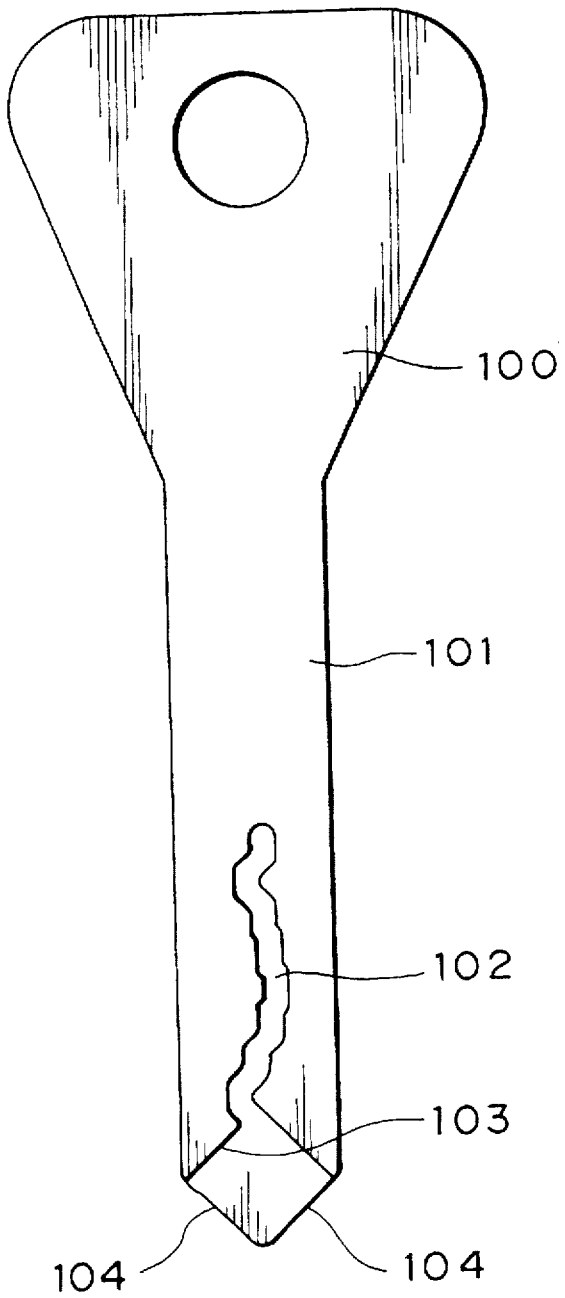
FIG. 4 is a plan view of a key according to such embodiment.

As FIGS. 1 and 4 show, the key 100 of the present embodiment has a zigzag key groove 102 (back side key groove 102 not shown) formed on opposite sides of key body 101. On opposite sides of the key 100 there are formed guide grooves 103 having a generally triangular shape in plan in order to facilitate engagement of the key with positioning projections **41*b*–48*b* of the tumblers 41–48. Further, in order to facilitate the insertion of the key into the tumblers 41–48, the forward end of the key body 101 has a pair of tapered faces 104** formed thereon to define a sharp-pointed end.

Figure 1A:
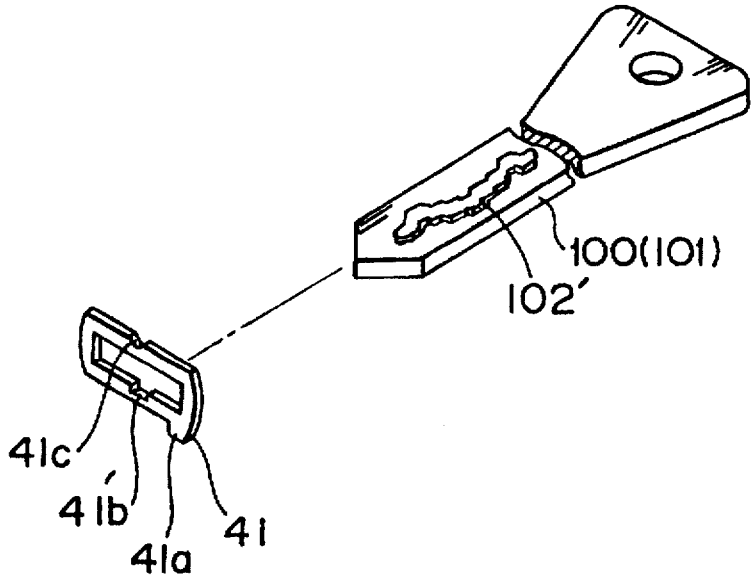
FIG. 1A is a perspective view of an alternative key and a tumbler.
Figure 2:
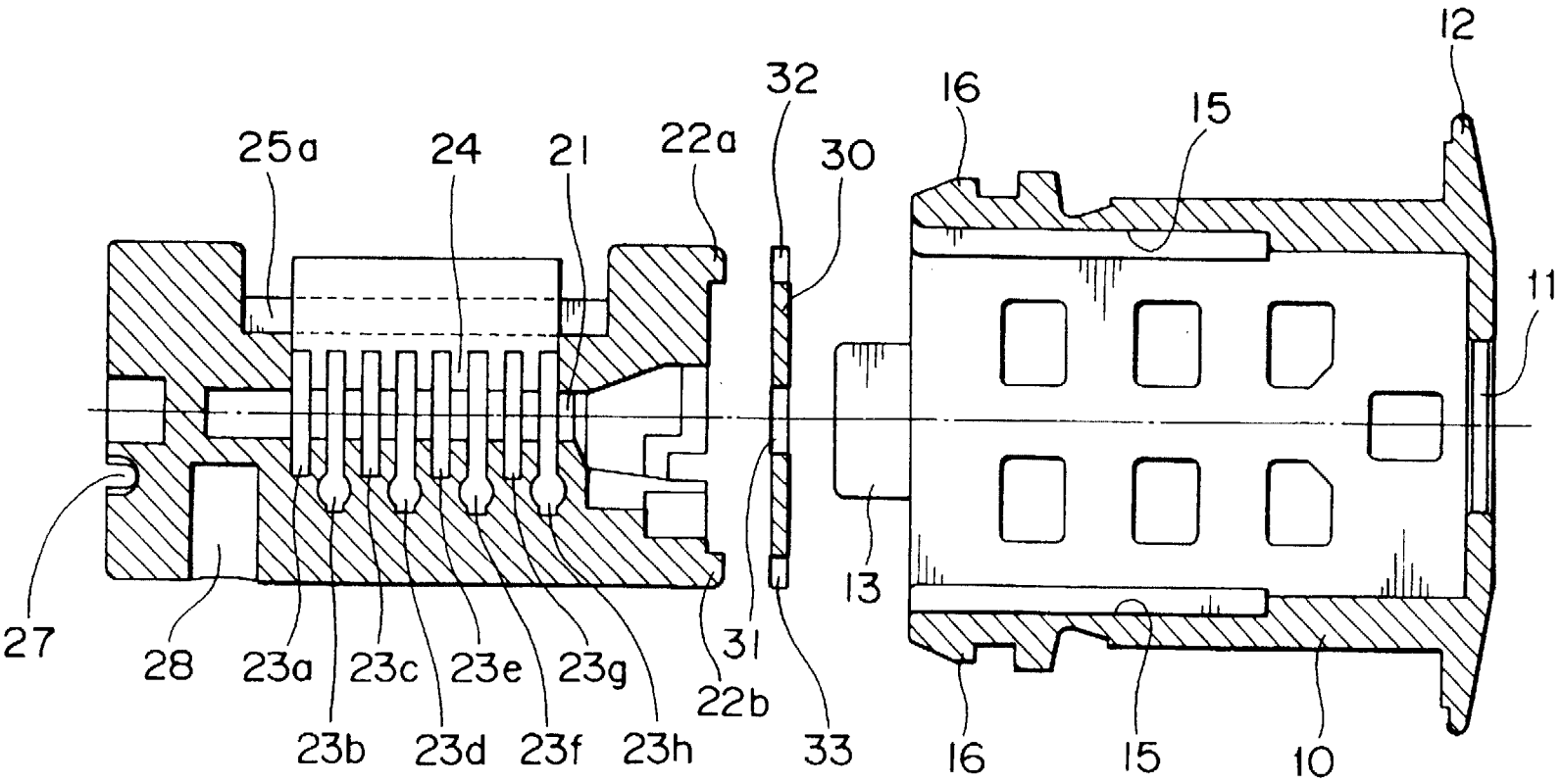
FIG. 2 is an exploded longitudinal sectional view showing an essential part thereof.

Alternatively, as shown in FIG. 1A, a positioning ridge 102 ' (back side positioning ridge now shown) may be formed on opposite sides of the key body 101 instead of the key groove 102, while a positioning recess **41*b*'–48*b* ' (only outermost ones shown) engageable with the positioning ridge 102 ' may be formed on the inner peripheral edge portion of the tumblers 41–48 instead of the positioning projections 41*b*–48*b***.

Next, operation of the lock cylinder of the present embodiment will be explained.

First, proper key 100 is inserted via center hole 31 into key hole 21 of main rotor 20. Thereupon, the tapered faces 104 abut against the inner peripheral edges of tumbler 48 and accordingly the tumbler 48 slides inwardly against the spring force of respective spring 40. Then, projection **48*b* (not shown) of the tumbler 48 slides into key groove 102 via the guide grooves 103 and accordingly the tumbler 48 slides within respective slit opening 23*h***.

When the key 100 is further forced in, positioning projections **47*b*–41*b* of tumblers 47–41 slide into the key groove 102 via tapered faces 104 and guide grooves 103 in the same manner as already described, so that tumblers 47–41 sequentially slide inwardly within respective slit openings. Upon completion of insertion of key 100, positioning projections 48*b*–41*b* of tumblers 48–41 are positioned at predetermined positions in the zigzag key groove 102, and position regulating notched portions 41*c*–48*c* of tumblers 41–48 are aligned in an intended operable alignment (i.e. rectilinear in the illustrated arrangement). As a result, the ridge-like raised portion 53 of the engagement bar 50 falls into positioning notched portions 41*c*–48*c* of tumblers 41–48. Thus, as FIG. 3 shows, left and right levers 61, 62 pivot outwardly so that locking pawls 61*c*, 62*c* respectively move into engagement with locking projections 71, 72 of the rear rotor 70**.

When key 100 is turned against the spring force of coil spring 80, rear rotor 70 turns through locking pawls **61*c*, 62*c* of left and right levers 61, 62 to actuate an unillustrated other component connected to the shaft portion 73 of rear rotor 70 to unlock the lock. Upon reaching a predetermined position, clicking ball 65 engages a click groove 15** to provide the desired click feel at the position where engagement can readily take place.

According to the present embodiment, the distance $l_1$ between respective pivot centers of left and right levers 61, 62 and respective working points of locking pawls **61*c*, 62*c* with respect to the rear rotor 70 is longer than the distance $l_2$ between respective pivot centers of left and right levers 61, 62 and respective working points of pairs of tongues 61*a*, 61*b* and 62*a*, 62*b* biasing the engagement bar 50. Therefore, even if the amount of shift of tongues 61*a*, 61*b* and 62*a*, 62*b* at their application points is small, the amount of lock engagement of the locking pawls 61*c*, 62*c* by left and right levers 61, 62 relative to the locking projections 71, 72 of the rear rotor 70** is large enough to insure accurate engagement and disengagement. This arrangement advantageously prevent malfunctions.

When an improper key is inserted, positioning projections **48*b*–41*b* of tumblers 48–41 will sequentially slide into the key groove of the improper key so that tumblers 48–41 will sequentially slide inwardly, as in the above stated case. However, positioning notched portions 41*c*–48*c* do not align in the intended operable alignment. Therefore, the ridge-like raised portion 53 of the engagement bar 50 does not fall into the positioning notched portions 41*c*–48*c*. As such, left and right levers 61, 62 are not allowed to pivot and locking pawls 61*c* and 62*c* do not move outwardly. Hence, locking pawls 61*c* and 62*c* cannot come into lock engagement with the locking projections 71, 72 of the rear rotor 70. Therefore, even if the improper key is turned, only the main rotor 20 rotates and the rear rotor 70, position regulated by coil spring 80**, does not rotate.

More particularly, according to the present embodiment, if an improper key is inserted into the tumblers 41–48, the key groove of the improper key fits on positioning projections **41*b*–48*b* of tumblers 41–48 to subject the tumblers 41–48 to forced position regulation. As a result, the ridge-like raised portion 53 of the engagement bar 50 is definitely forced out of the positioning notched portions 41*c*–48*c* of tumblers 41–48**. Thus, a malfunction due to use of an improper key can be prevented effectively.

If the tip of a screwdriver is inserted into the key hole 21 of the main rotor 20 and if forced turning is attempted, the result is that only the main rotor 20 turns idly, as earlier stated, because outer ends of tumblers 41–48 only abut against the inner periphery of the holder 10. Thus, any occurrence of theft by so-called high load destruction can be prevented effectively.

According to the present embodiment, because there is no possibility of any high load due to forced turning being applied to the main rotor, the main rotor and other components may be formed from resin material. This results in reduced cost of production.

In the foregoing embodiment, the operable alignment of positioning notched portions **41*c*–48*c* of tumblers 41–48 is designed to be straight or rectilinear. However, it is not intended that the invention be limited to such arrangement. Alternatively, operable alignment may be a zigzag arrangement. Needless to say, in such case it is necessary that ridge-like raised portion 53 of the engagement bar 50** be of a complementary zigzag pattern.

Also in the foregoing embodiment, upon removal of the key, all of the tumblers biased in the same direction have their respective projections, namely, **41*b*, 43*b*, 45*b* and 47*b* for one set of tumblers and 42*b*, 44*b*, 46*b* and 48*b*** for the other set of tumblers, aligned along a straight line. This provides an advantage that the interior arrangement cannot be read by an endoscope or the like.

Figure 5:
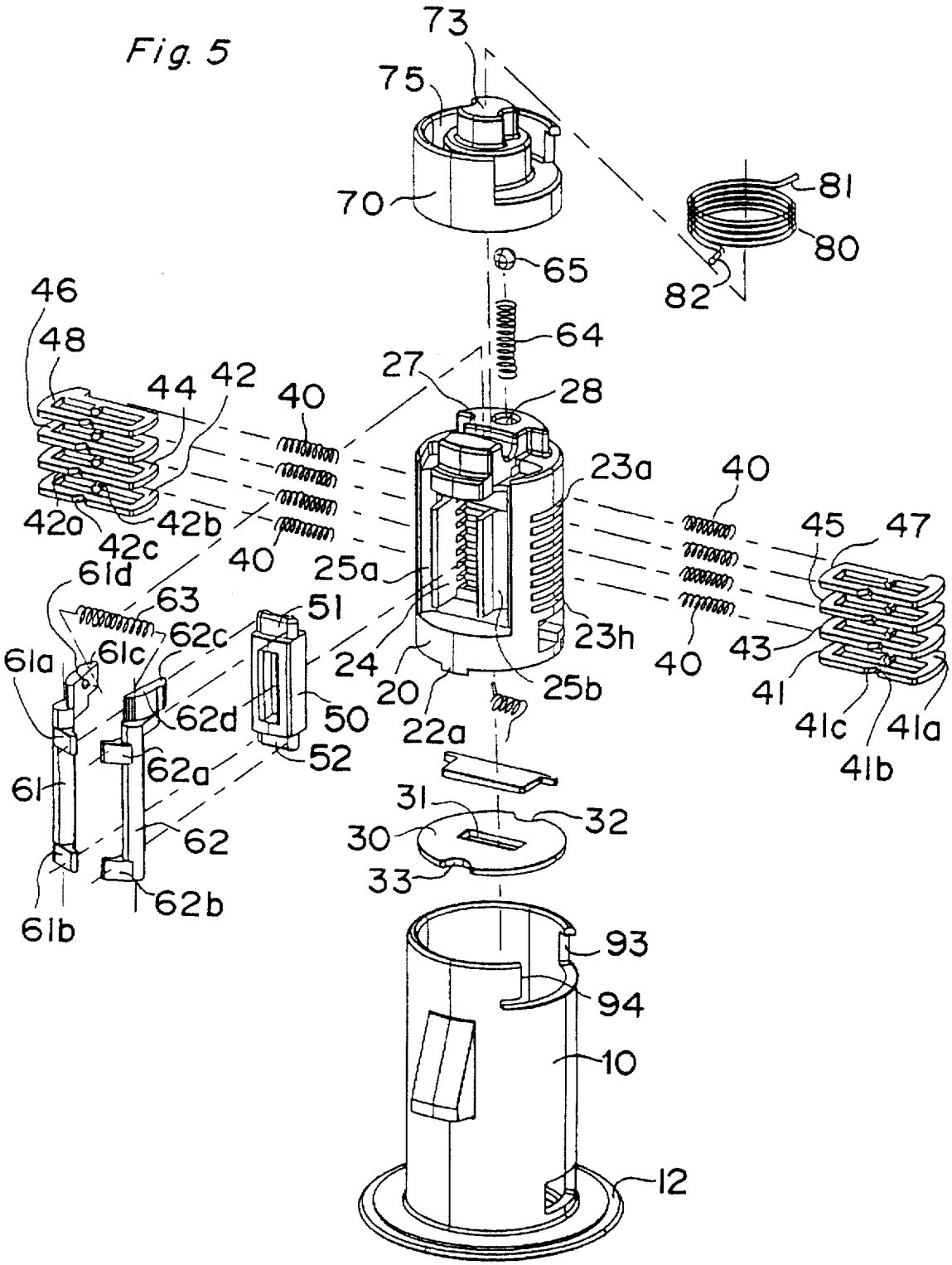
FIG. 5 is an exploded perspective view showing another embodiment of a lock cylinder according to the present invention.
Figure 6:
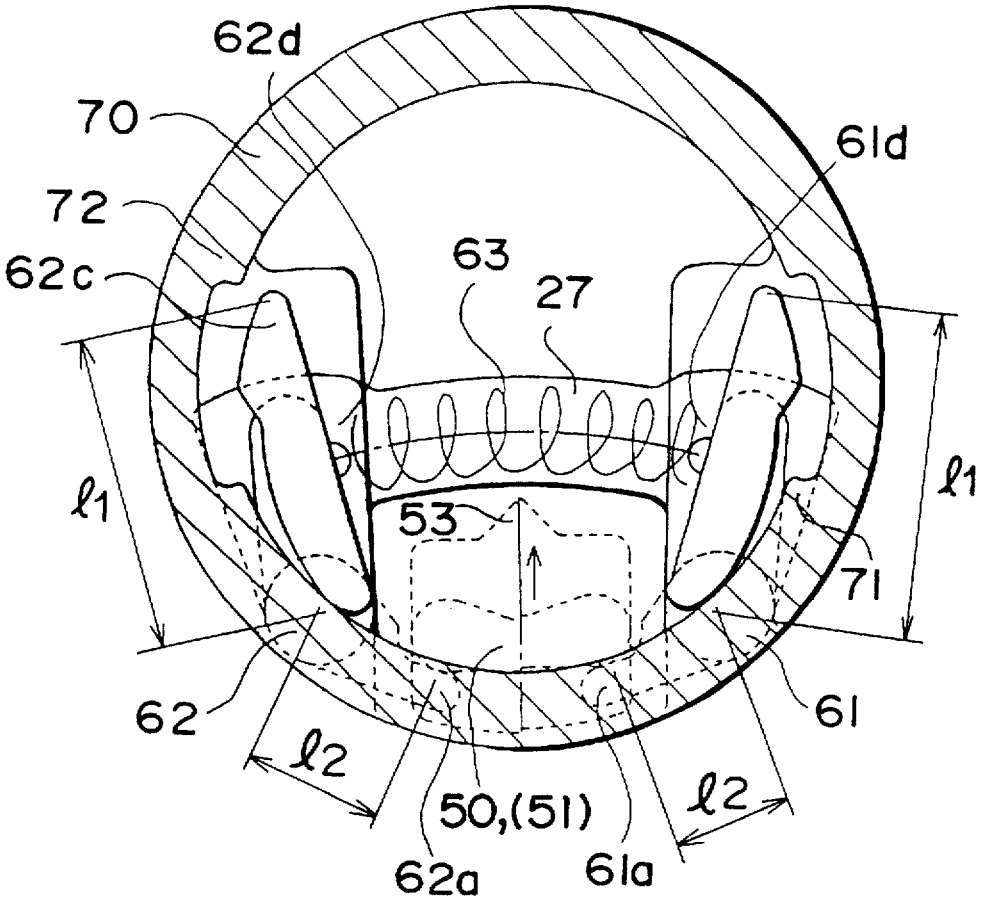
FIG. 6 is a transverse sectional view of the embodiment illustrated in FIG. 5.

Another embodiment of a lock cylinder according to the present invention is illustrated in FIGS. 5 and 6. In this embodiment, the cylinder holder 10 includes the notched edge portion 93 and 94, which co-operate with the portions 81 and 82 of the coil spring 80. The rear rotor 70 is configured in the region having the locking projections 71 and 72 so that the rear rotor 70 and the main rotor 20 each have an outside diameter slightly smaller than the inside diameter of the cylindrical holder 10, thereby permitting both the rear rotor 70 and the main rotor 20 to be wholly contained within the cylindrical cavity of holder 10 when the lock cylinder is assembled.

Referring to FIG. 6, a surface of each of the levers 61 and 62 is at all times in contact with a surface of the rear rotor 70, thereby establishing the lateral and rotational position of the levers 61 and 62 relative to the locking protrusions 71 and 72, and the concentricity of the rear rotor 70 relative to the main rotor 20.

Referring now to FIG. 5, the receiving hole 28 in the main rotor 20, for receiving the spring 64 and the clicking or detent ball 65, is included on the face of rotor 20 proximate the rear rotor 70. The bottom surface of the rear rotor 70 includes two dimple-like indentations, which co-operate with the detent ball 65 to produce a detent click at two rotational positions separated by 180 degrees.

As seen by comparing the embodiment illustrated in FIGS. 5 and 6 with the embodiment illustrated in FIGS. 1 through 4, changing the shape of the cylindrical holder 10 to include the notched edge portions 93 and 94, of the rear rotor 70 and its locking projections 71 and 72, of the main rotor 20 and its notch groove 27, and of the levers 61 and 62, and repositioning receiving hole 28 and its associated spring 64 and click ball 65 in the main rotor 20, permits elimination of annular cap 90, of locking projections **26*a* and 26*b* of the main rotor 20, and of positioning arms 13 and 14 and grooves 15 of the cylindrical holder 10**.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A lock cylinder comprising:

a rotatable main rotor having therein an axial key hole, a plurality of laterally extending slits in communication with said key hole and a recess communicating with both said key hole and said slits;

a plurality of tumblers slidably positioned in respective said slits, each said tumbler having a positioning portion, and said tumblers being slidable in said slits to bring said positioning portions into an operable alignment;

an engagement bar movably positioned in said recess and having an engagement portion engageable with said positioning portions when said positioning portions are in said operable alignment;

an interlocking member separate from said engagement bar and biasing said engagement bar toward said tumblers such that when said positioning portions are in said operable alignment said engagement bar is moved in said recess to an engaged position with said engagement portion in engagement with said positioning portions;

a rear rotor; and said interlocking member being movable, in response to said engagement bar being moved to said engaged position thereof, to engage said rear rotor with said main rotor so that said rear rotor is rotatable with said main rotor.

2. A lock cylinder as claimed in claim 1, wherein said positioning portion of each said tumbler comprises a notch therein, and said engagement portion of said engagement bar comprises a projection extending from said engagement bar.

3. A lock cylinder as claimed in claim 2, wherein said projection is rectilinear, and said operable alignment comprises a rectilinear alignment of said notches.

4. A lock cylinder as claimed in claim 2, wherein each said notch is formed on an upper edge portion of the respective said tumbler, and said projection extends downwardly from an underside of said engagement bar.

5. A lock cylinder as claimed in claim 1, wherein said tumblers have respective positioning projections, and further comprising a key to be inserted into said key hole, said key having therein a groove to receive said positioning projections, and said groove having a configuration such that when said positioning projections are received in said groove said positioning portions of said tumblers are in said operable alignment.

6. A lock cylinder as claimed in claim 5, wherein said positioning projections are formed at inner peripheral edge portions of respective said tumblers.

7. A lock cylinder as claimed in claim 5, wherein said key includes a pointed forward end portion defined by a tapered face, such that when said key is inserted into said tumblers said positioning projections of said tumblers are urged toward said groove of said key.

8. A lock cylinder as claimed in claim 1, wherein said tumblers have respective positioning recesses, and further comprising a key to be inserted into said key hole, said key having thereon a ridge to be received in said positioning recesses, and said ridge having a configuration such that when said ridge is received in said positioning recesses said positioning portions of said tumblers are in said operable alignment.

9. A lock cylinder as claimed in claim 8, wherein said positioning recesses are formed at inner peripheral edge portions of respective said tumblers.

10. A lock cylinder as claimed in claim 8, wherein said key includes a pointed forward end portion defined by a tapered face, such that when said key is inserted into said tumblers said positioning recesses of said tumblers are urged toward said ridge of said key.

11. A lock cylinder comprising:

a rotatable main rotor having therein an axial key hole, a plurality of laterally extending slits in communication with said key hole and a recess communicating with both said key hole and said slits;

a plurality of tumblers slidably positioned in respective said slits, each said tumbler having a positioning portion, and said tumblers being slidable in said slits to bring said positioning portions into an operable alignment;

an engagement bar movably positioned in said recess and having an engagement portion engageable with said positioning portions when said positioning portions are in said operable alignment;

at least one lever pivotally mounted to said main rotor, said lever having a tongue abuttable against said engagement bar;

a spring supported by said lever and biasing said engagement bar toward said tumblers such that when said positioning portions are in said operable alignment said engagement bar is moved in said recess to an engaged position with said engagement portion in engagement with said positioning portions;

a rear rotor; and said lever having a locking pawl movable, in response to said engagement bar being moved to said engaged position thereof, to engage said rear rotor with said main rotor so that said rear rotor is rotatable with said main rotor.

12. A lock cylinder as claimed in claim 11, wherein said positioning portion of each said tumbler comprises a notch therein, and said engagement portion of said engagement bar comprises a projection extending from said engagement bar.

13. A lock cylinder as claimed in claim 12, wherein said projection is rectilinear, and said operable alignment comprises a rectilinear alignment of said notches.

14. A lock cylinder as claimed in claim 12, wherein each said notch is formed on an upper edge portion of the respective said tumbler, and said projection extends downwardly from an underside of said engagement bar.

15. A lock cylinder as claimed in claim 11, wherein said tumblers have respective positioning projections, and further comprising a key to be inserted into said key hole, said key having therein a groove to receive said positioning projections, and said groove having a configuration such that when said positioning projections are received in said groove said positioning portions of said tumblers are in said operable alignment.

16. A lock cylinder as claimed in claim 15, wherein said positioning projections are formed at inner peripheral edge portions of respective said tumblers.

17. A lock cylinder as claimed in claim 15, wherein said key includes a pointed forward end portion defined by a tapered face, such that when said key is inserted into said tumblers said positioning projections of said tumblers are urged toward said groove of said key.

18. A lock cylinder as claimed in claim 11, wherein said tumblers have respective positioning recesses, and further comprising a key to be inserted into said key hole, said key having thereon a ridge to be received in said positioning recesses, and said ridge having a configuration such that when said ridge is received in said positioning recesses said positioning portions of said tumblers are in said operable alignment.

19. A lock cylinder as claimed in claim 18, wherein said positioning recesses are formed at inner peripheral edge portions of respective said tumblers.

20. A lock cylinder as claimed in claims 18, wherein said key includes a pointed forward end portion defined by a tapered face, such that when said key is inserted into said tumblers said positioning recesses of said tumblers are urged toward said ridge of said key.

21. A lock cylinder as claimed in claim 11, wherein said lever pivots about a pivot center, and a distance between said pivot center and a working point of said locking pawl locked to said rear rotor is greater than a distance between said pivot center and a working point of said tongue against said engagement bar.

22. A lock cylinder as claimed in claim 21, wherein said tumblers have respective positioning projections, and further comprising a key to be inserted into said key hole, said key having therein a groove to receive said positioning projections, and said groove having a configuration such that when said positioning projections are received in said groove said positioning portions of said tumblers are in said operable alignment.

23. A lock cylinder as claimed in claim 22, wherein said positioning projections are formed at inner peripheral edge portions of respective said tumblers.

24. A lock cylinder as claimed in claim 22, wherein said key includes a pointed forward end portion defined by a tapered face, such that when said key is inserted into said tumblers said positioning projections of said tumblers are urged toward said groove of said key.

25. A lock cylinder as claimed in claim 21, wherein said tumblers have respective positioning recesses, and further comprising a key to be inserted into said key hole, said key having thereon a ridge to be received in said positioning recesses, and said ridge having a configuration such that when said ridge is received in said positioning recesses said positioning portions of said tumblers are in said operable alignment.

26. A lock cylinder as claimed in claim 25, wherein said positioning recesses are formed at inner peripheral edge portions of respective said tumblers.

27. A lock cylinder as claimed in claim 25, wherein said key includes a pointed forward end portion defined by a tapered face, such that when said key is inserted into said tumblers said positioning recesses of said tumblers are urged toward said ridge of said key.

28. A lock cylinder as claimed claim 11, comprising two levers pivotally mounted to said main rotor, each said lever having a respective said tongue abuttable against said engagement bar, and wherein said spring is positioned between said two levers and biases said levers apart and into abutment with said engagement bar to urge said engagement bar toward said tumblers.

* * * * *